US006135584A

United States Patent [19]

Happ

[11] Patent Number: 6,135,584

[45] **Date of Patent: *Oct. 24, 2000**

[54] VERTICAL DRAWER WITH CATCH BASIN AND STORAGE CHEST CONTAINING SAME

[75] Inventor: Kenneth C. Happ, Burlington, Wis.

[73] Assignee: Snap-on Tools Company, Kenosha, Wis.

[ * ] Notice: This patent is subject to a terminal disclaimer.

[21] Appl. No.: 09/263,337

[22] Filed: Mar. 5, 1999

[51] Int. Cl.[7] ..... A47B 88/00

[52] U.S. Cl. ..... 312/330.1; 312/334.25

[58] Field of Search ..... 312/330.1, 348.3, 312/183, 185, 270.3, 283, 293.2, 334.24, 334.25, 334.28, 902, 321.5, 322, 323

[56] References Cited

U.S. PATENT DOCUMENTS

| | | | |
|---|---|---|---|
| 415,058 | 11/1889 | Phillips | 312/322 X |
| 511,894 | 1/1894 | Kahn | 312/334.28 X |
| 796,600 | 8/1905 | McLane et al. | 312/322 X |
| 1,055,109 | 3/1913 | Whitaker | 312/322 X |
| 1,121,132 | 12/1914 | Richardson | 312/322 X |
| 1,281,923 | 10/1918 | Fales | 312/334.28 X |
| 1,736,235 | 11/1929 | Von Kersburg | 312/322 X |
| 1,750,291 | 3/1930 | Whetstone | 312/330.1 X |
| 2,254,431 | 9/1941 | Levine | 312/334.24 X |
| 2,795,834 | 6/1957 | Szoke . | |
| 2,923,584 | 2/1960 | Broderick, Jr. | 312/334.25 X |
| 3,853,364 | 12/1974 | Lundberg | 312/184 |
| 3,874,756 | 4/1975 | Greene | 312/234 |
| 4,095,854 | 6/1978 | Teramachi . | |
| 4,170,392 | 10/1979 | Spevak | 312/283 |
| 4,285,556 | 8/1981 | Loeffel | 312/902 X |
| 4,397,509 | 8/1983 | Miller et al. | 312/217 X |
| 4,606,588 | 8/1986 | Koch | 312/330.1 X |
| 4,958,730 | 9/1990 | Bunten | 312/311 X |
| 5,131,732 | 7/1992 | Lane et al. | 312/190 |
| 5,468,063 | 11/1995 | Simonek | 312/334.28 |
| 5,590,940 | 1/1997 | Richard | 312/287 |
| 5,597,219 | 1/1997 | Horn et al. | 312/322 X |
| 5,992,956 | 11/1999 | Slivon | 312/334.25 |

FOREIGN PATENT DOCUMENTS

| | | | |
|---|---|---|---|
| 116013 | 8/1984 | European Pat. Off. | 312/348.3 |
| 1568372 | 5/1969 | France | 312/348.3 |
| 2469149 | 5/1981 | France | 312/322 |
| 922464 | 1/1955 | Germany . | |
| 358208 | 12/1961 | Switzerland | 312/334.25 |
| 506617 | 6/1939 | United Kingdom | 312/348.3 |

*Primary Examiner*—Peter M. Cuomo
*Assistant Examiner*—James O. Hansen
*Attorney, Agent, or Firm*—Seyfarth Shaw

[57] ABSTRACT

A storage chest, or tool cabinet, is provided. The storage chest includes a wall structure defining an open-front compartment, and at least one upstanding drawer slidable into and out of the compartment through the open front. Each drawer includes an upstanding holding panel having upper and lower ends and front and back surfaces, a support coupled to the panel for supporting items above the lower end, and a catch basin extending below the lower end of the holding panel and projecting forwardly from the front surface. The catch basin includes a front flange projecting upwardly from the lower end toward the upper end. The catch basin advantageously catches and retains items that may fall off the holding panel.

19 Claims, 5 Drawing Sheets

VERTICAL DRAWER WITH CATCH BASIN AND STORAGE CHEST CONTAINING SAME

BACKGROUND OF THE INVENTION

1. Field of the Invention

The present invention relates to storage cabinets for articles such as tools and, in particular, to vertically-oriented drawers or like storage units for such cabinets.

2. Description of the Prior Art

Typical tool chests or cabinets are provided with horizontally arranged shelves, drawers, trays and the like for containing or supporting tools or other items. These horizontal drawers can sometimes make it difficult for the user, such as an automotive mechanic or the like, to readily see or gain access to the contents of a drawer.

In other applications, it has also been known to provide cabinets with vertically-arranged drawers or storage units which can be slidably moved between closed positions within the cabinet and open positions extending from the cabinet, and on which items may be hung or clipped. These drawers, however, do not have a structure to catch a hung item that falls off in movement and which may strike other objects or a user. Depending on the hung item which falls, a user may be seriously hurt, other objects may be damaged, or the item may be damaged or lost.

SUMMARY OF THE INVENTION

It is a general object of the invention to provide a storage chest which avoids the disadvantages of prior chests while affording additional structural and operating advantages.

An important feature of the invention is the provision of a chest which has an upstanding drawer that hangs and vertically displays tools or other items, yet prevents items hung thereon which become dislodged, or fall in use, from becoming lost or causing damage.

Another feature of the invention is the provision of a chest with a drawer of the type set forth, which is symmetrical such that it can be arranged to face either the left or right side of the chest and with either end disposed up or down without modification.

Certain ones of these or other features may be attained by providing a storage chest including a wall structure defining an open-front compartment, and at least one upstanding drawer slidable into and out of the compartment through the open front. Each drawer includes an upstanding holding panel having upper and lower ends and front and back surfaces. A fastener is coupled to the panel for supporting items above the lower end, and a catch basin extends below the lower end of the holding panel and forwardly of the front surface, and includes a front flange projecting upwardly from the lower end toward the upper end.

The invention consists of certain novel features and a combination of parts hereinafter fully described, illustrated in the accompanying drawings, and particularly pointed out in the appended claims, it being understood that various changes in the details may be made without departing from the spirit, or sacrificing any of the advantages of the present invention.

BRIEF DESCRIPTION OF THE DRAWINGS

For the purpose of facilitating an understanding of the invention, there is illustrated in the accompanying drawings a preferred embodiment thereof, from an inspection of which, when considered in connection with the following description, the invention, its construction and operation, and many of its advantages should be readily understood and appreciated.

DETAILED DESCRIPTION OF THE PREFERRED EMBODIMENT

Figure 1:
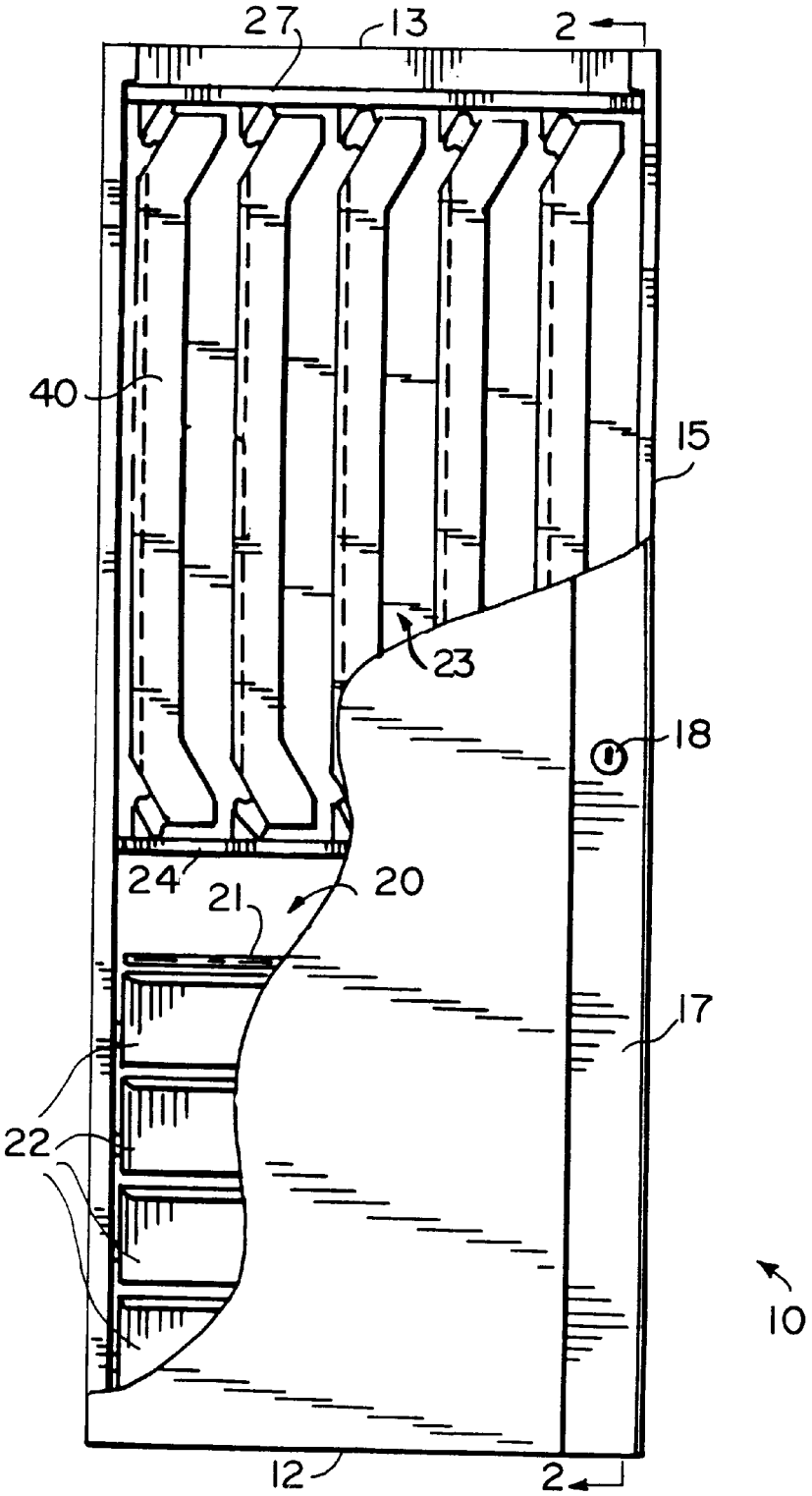
FIG. 1 is a front elevational view of a tool cabinet constructed in accordance with and embodying features of the present invention, with a portion of the door broken away to show internal construction.
Figure 2:
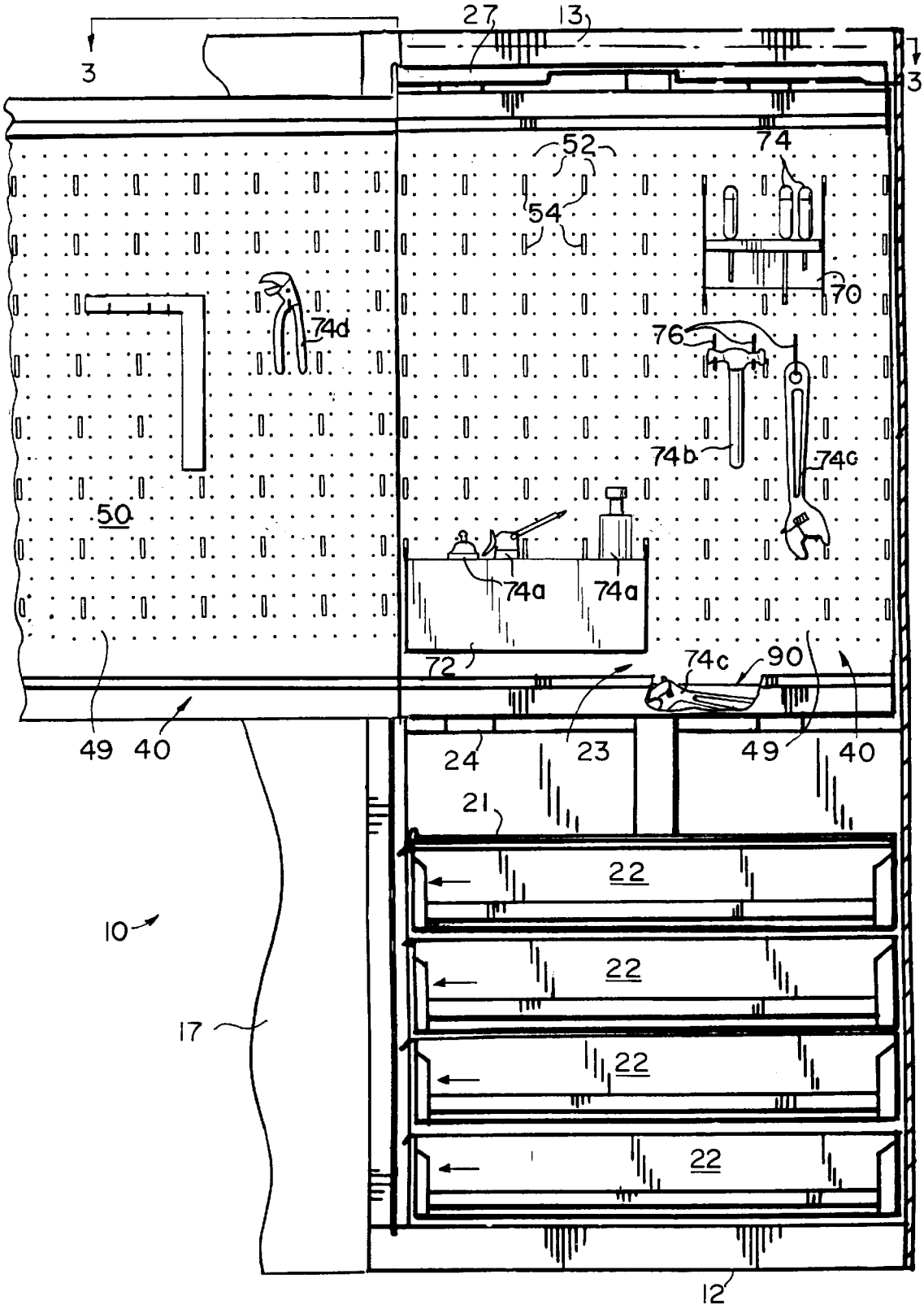
FIG. 2 is an enlarged, fragmentary view in vertical section taken along the line 2—2 in FIG. 1, with the door in an open position and illustrating one vertical drawer in open position with a portion of another vertical drawer broken away to better illustrate the catch basin.
Figure 3:
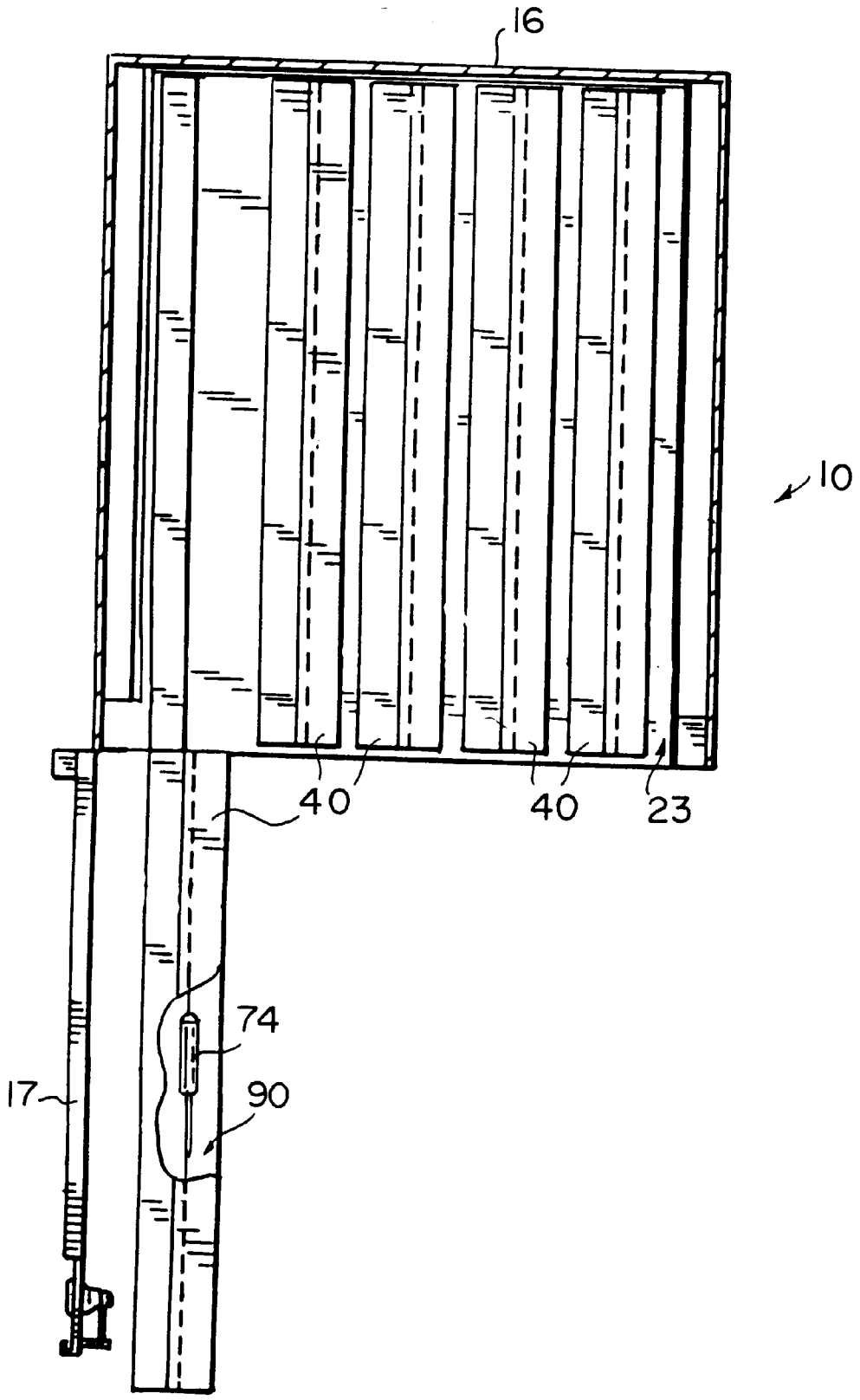
FIG. 3 is a reduced view in horizontal section taken along the line 3—3 in FIG. 2.

Referring to FIGS. 1–3, there is illustrated a storage chest or tool cabinet, generally designated by the numeral 10, constructed in accordance with and embodying the features of the present invention. The tool cabinet 10 has a generally box-like, upstanding housing 11 including a bottom wall 12, a top wall 13, opposed side walls 14 and 15, and a rear wall 16, being closed by a front door 17 provide with a lock 18. The tool cabinet 10 includes a lower storage compartment 20, defined generally between a horizontal shelf 21 and the bottom wall 12. A plurality of vertically-spaced horizontal drawers 22 are disposed in the lower storage compartment 20 and are mounted for sliding movement on standard ball slide assemblies (not shown) for movement between a closed position, illustrated in FIGS. 1 and 2, disposed entirely within the lower storage compartment 20, and an open position extending from the storage compartment 20 (not shown). The drawers 22 are opened by moving in the direction of the arrows in FIG. 2.

The tool cabinet 10 also has an open-front upper storage compartment 23 formed by a wall structure including the opposed sidewalls 14, 15, the rear wall 16, and a framework including a lower frame member 24 mounted above the shelf 21 and an upper frame member 27 mounted beneath the top wall 13, which frame members respectively define the lower and upper ends of the upper storage compartment 23.

Figure 4:
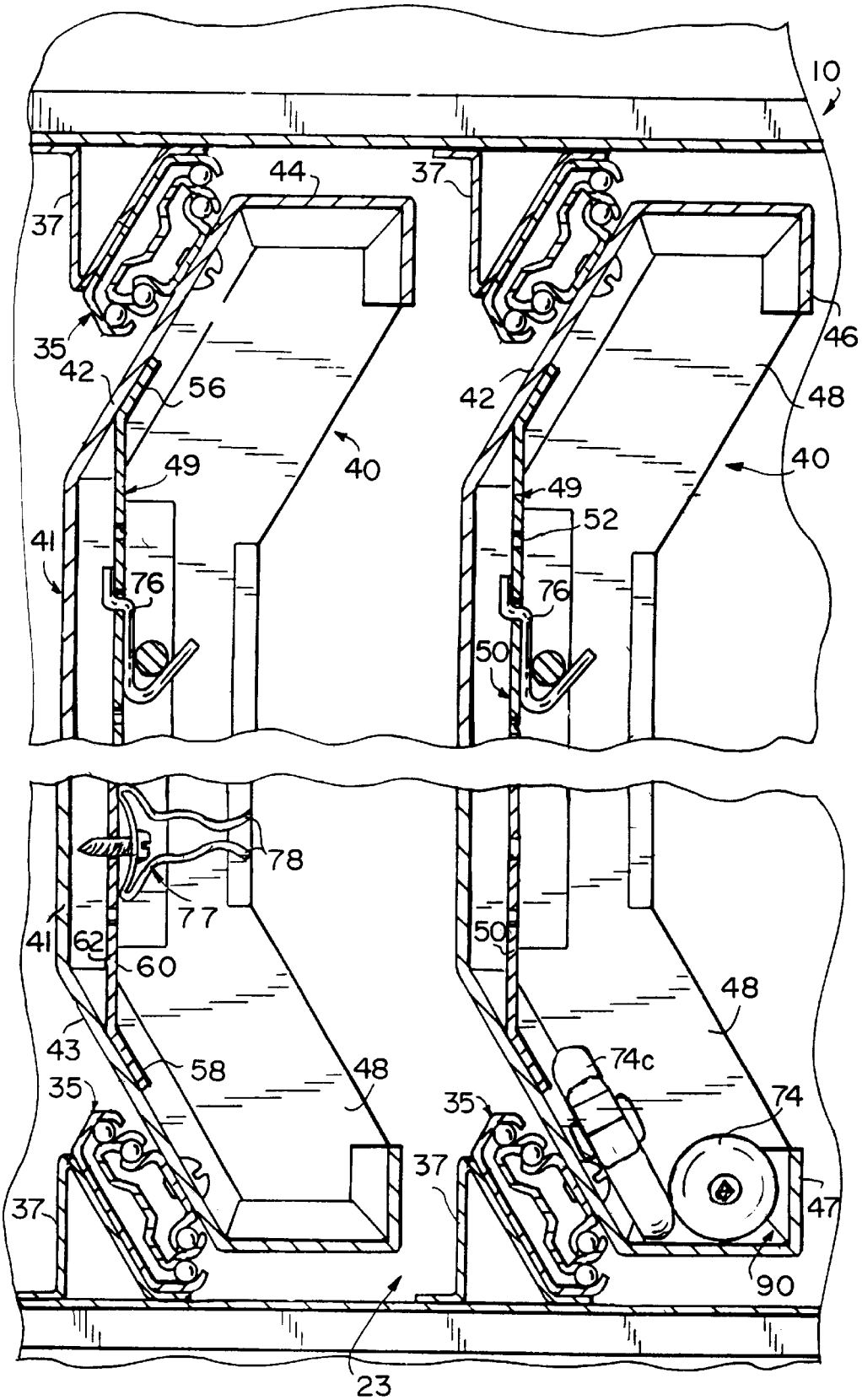
FIG. 4 is an enlarged, fragmentary view in vertical section of the upper portion of FIG. 1, illustrating details of the vertical drawers and drawer slide assemblies therefor.
Figure 5:
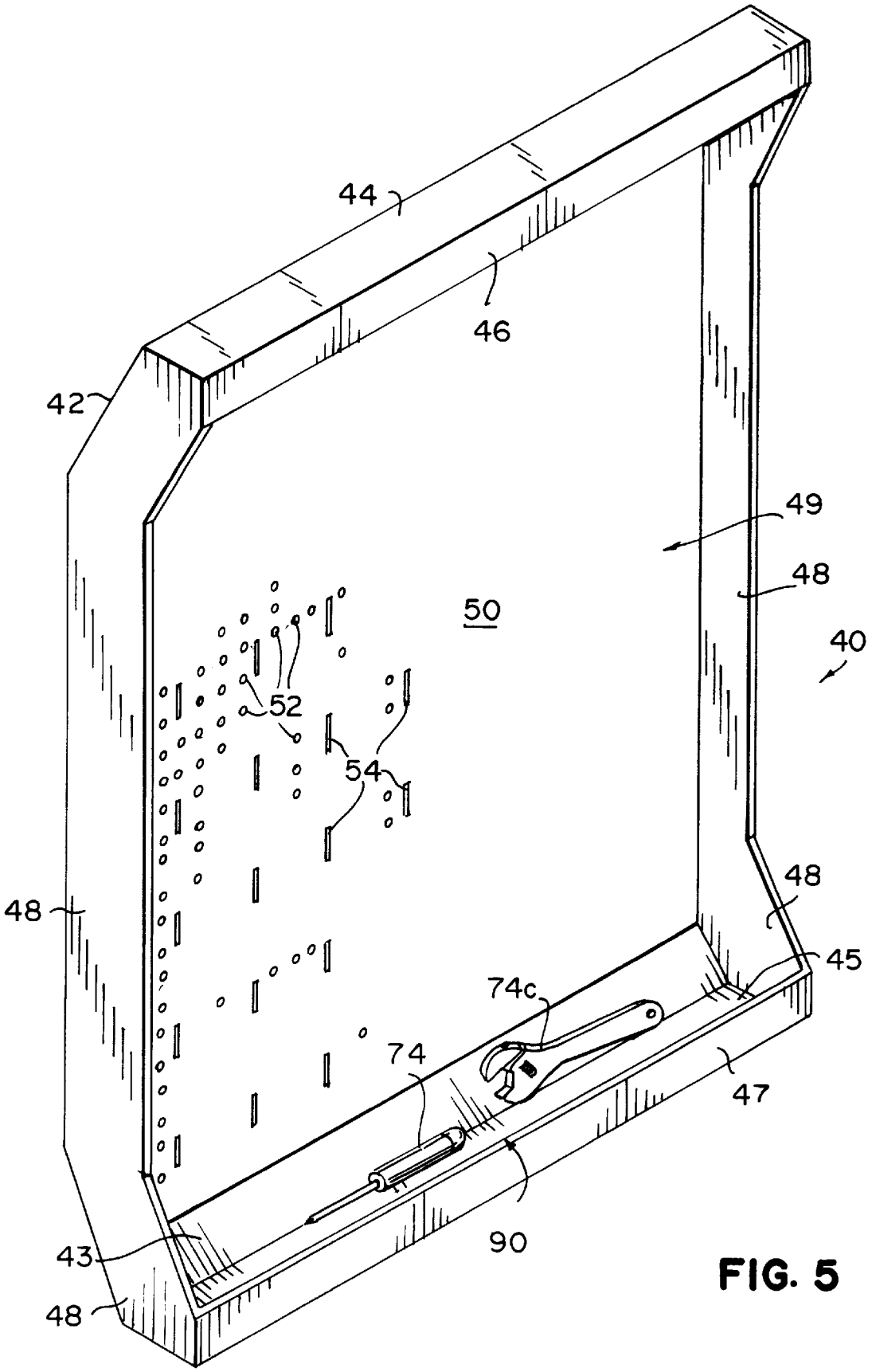
FIG. 5 is an enlarged, front perspective view of one of the vertical drawers of the cabinet of FIG. 1.

Also disposed in the upper storage compartment 23 are a plurality of vertically-oriented drawers or panel assemblies 40, with each drawer 40 being slidable into and out of the open-front compartment 23 via, as seen in FIG. 4, vertically-aligned pairs of drawer slide assemblies 35 coupled to the upper and lower ends of the drawer 40 and to slide supports 37 disposed on the upper and lower frame members 27, 24. The drawer slide assemblies 35 and the supports 24, 27 are discussed in much greater detail in commonly assigned U.S. Pat. No. 5,992,956, entitled "Inclined Slide Assemblies for Vertical Drawers", the disclosure of which is incorporated herein by reference.

The drawers 40 are of identical construction, each having a vertical wall 41 arranged parallel to the cabinet sidewalls 14 and 15 and integral at its upper and lower ends with upper and lower inclined walls 42 and 43, which respectively slope upwardly and downwardly in the same lateral direction. The inclined walls 42 and 43 are, respectively, integral at their distal ends with parallel top and bottom walls 44 and 45. The top and bottom walls 44, 45 are, respectively, integral at their distal ends with top and bottom flange walls 46, 47 parallel to vertical wall 41. All of the walls 41–47 are provided at their front and rear ends with attachment flanges to facilitate attachment to end walls 48. Walls 41–48 form a drawer wall structure defining the boundary of the drawer 40.

Mounted in the drawer 40 between the inclined walls 42 and 43 is a tool holding panel 49, which has a planar central portion 50 which is perforated with a plurality of substantially uniformly spaced holes 52 and vertically elongated slots 54. The planar central portion 50 is parallel to the vertical wall 41 and is integral at its upper and lower ends with inclined portions which are, respectively, attached to the inclined walls 42 and 43, so that the central portion 50 is spaced from the vertical wall 41. As seen in FIG. 4, the tool holding panel 49 has upper and lower ends 56, 58 and front and back surfaces 60, 62. The bottom flange wall 47 projects up from the bottom wall 45. The top flange wall 46 projects down from the top wall 44 and is preferably substantially coplanar with the bottom flange wall 47.

It will be appreciated that tools can be hung or clipped onto the tool holding panel 49 by any known means. Thus, for example, separate tool holders 70 or 72 could be hung on the tool holding panel 49 by the use of suitable hooks, clips, straps, or the like, for respectively supporting pluralities of tools, such as screwdrivers 74 or cans or other containers 74*a*. Alternatively, tools, such as a hammer 74*b* (FIG. 2) or other type of tool 74*c* or 74*d* (FIGS. 2 and 4) may be individually mounted by the use of hooks 76 or other supports, including those described above, in a known manner. A preferred tool holder, as seen in FIG. 4, is a resilient clip 77 mounted to the panel 49 by a sheet metal screw, or the like, which has two resilient arms 78 for holding a tool therebetween. Such clips are more fully described in U.S. Pat. No. 2,795,834 to Szoke, entitled "Resilient Clip," the specification of which is hereby incorporated by reference.

An important feature of the present invention is that each drawer includes a catch basin 90 disposed below the tool holding panel 49 and extending forwardly of the front surface 60 a distance which is preferably greater than the distance the hooks 76 or other items hung or coupled to the tool holding panel 49 project forwardly therefrom. The catch basin 90 is formed by the lower inclined wall 43, the bottom wall 45, the bottom flange wall 47 and lower portions of the two end walls 48. If a tool or other object inadvertently falls off the panel 49, it may be caught in the catch basin 90. The lower inclined wall 43 or the bottom wall 45 will stop the tool from falling and the bottom flange wall 47 along with the lower portion of the end walls 48 retain the tool in the catch basin 90.

The vertical drawers 40 of the storage chest 10 are advantageously symmetrical about a plane located midway between the top and bottom walls 44 and 45 and parallel thereto. This allows for quick assembly, because an assembler could either place a drawer 40 into compartment 23 with the top wall 44 of the drawer 40 adjacent to the top of the compartment 23 facing the upper frame member 27 or adjacent to the bottom of compartment 23 facing the lower frame member 24. The symmetry of the drawer 40 allows, in the latter case, the top wall 44, the upper inclined wall 42, the top flange wall 46 and the portion of the end walls 48 adjacent to the top wall 44 to form a catch basin 90.

While particular embodiments of the present invention have been shown and described, it will be appreciated by those skilled in the art that changes and modifications may be made without departing from the invention in its broader aspects. Therefore, the aim in the appended claims is to cover all such changes and modifications as fall within the true spirit and scope of the invention. The matter set forth in the foregoing description and accompanying drawings is offered by way of illustration only and not as a limitation. The actual scope of the invention is intended to be defined in the following claims when viewed in their proper perspective based on the prior art.

What is claimed is:

1. A storage chest comprising:

a wall structure defining an open-front compartment; and at least one upstanding drawer slidable into and out of the compartment through the open front, each said at least one drawer comprising an upstanding holding panel having a central holding portion with upper and lower ends and front and back surfaces, a support coupled to the holding portion supporting items above the lower end, a drawer wall structure coupled to the holding panel and defining a terminal front edge of the drawer forward of the central holding portion and between the upper and lower ends, and a catch basin disposed below the lower end and having a portion extending forwardly of the terminal front edge.

2. The chest of claim 1, wherein the catch basin includes a front flange projecting upwardly.

3. The chest of claim 2, wherein the catch basin includes a bottom catch wall projecting forwardly of the front surface and connected to the front flange.

4. The chest of claim 3, wherein the central holding portion is substantially planar and the bottom catch wall is substantially perpendicular to the central holding portion and the front flange is substantially parallel to the central holding portion.

5. The chest of claim 4, wherein the catch basin includes an inclined wall connected to and inclined with respect to both the bottom catch wall and the holding panel.

6. The chest of claim 5, wherein the catch basin includes two substantially parallel endwalls respectively connected to opposite ends of each of the front flange and bottom catch wall.

7. The chest of claim 6, wherein each said at least one drawer further comprises a back wall coupled to the inclined wall and substantially parallel to the the central holding portion and facing the back surface.

8. The chest of claim 2, wherein the central holding portion has a plurality of apertures therein, wherein the support includes a portion disposed through an aperture.

9. The chest of claim 8, wherein the support has a supporting portion projecting a first distance forwardly of the front surface, and the catch basin extends forwardly of the front surface a second distance, the second distance greater than the first distance.

10. The chest of claim 2 including a plurality of said at least one upstanding drawer.

11. An upstanding drawer for sliding into and out of an open front compartment, the drawer comprising:

an upstanding holding panel having a panel width, upper and lower ends and front and back surfaces;

a support coupled to the panel for supporting items above the lower end; and a catch basin disposed below the holding panel and projecting forwardly of the front surface and including an inclined wall portion disposed below the lower end and having a top end and a bottom end and a width substantially equal to the panel width, wherein the bottom end projects forwardly of the holding panel a distance greater than the top end.

12. The drawer of claim 11, wherein the catch basin includes a front flange projecting upwardly.

13. The drawer of claim 12, wherein the catch basin includes a bottom catch wall projecting forwardly of the inclined wall and connected to the front flange.

14. The drawer of claim 13, wherein the holding panel includes a substantially planar portion and the bottom catch wall is substantially perpendicular to the planar portion and the front flange is substantially parallel to the planar portion.

15. The drawer of claim 14, wherein the inclined wall is connected to and inclined with respect to both the bottom catch wall and the holding panel.

16. The drawer of claim 15, wherein the catch basin includes two substantially parallel endwalls respectively connected to opposite ends of each of the front flange and bottom catch wall.

17. The drawer of claim 15, and further comprising a back wall coupled to the inclined wall and substantially parallel to the planar portion of the holding panel and facing the back surface.

18. The drawer of claim 17, and further comprising an upper wall substantially parallel to the bottom catch wall, wherein the drawer is symmetrical about a plane disposed midway between the upper wall and bottom catch wall.

19. The drawer of claim 12, wherein the holding panel has a plurality of apertures therein, and further comprising at least one tool-supporting fastener disposed in the aperture.

* * * * *